US009914565B2

(12) United States Patent
Davis et al.

(10) Patent No.: US 9,914,565 B2
(45) Date of Patent: Mar. 13, 2018

(54) SYNTHETIC CLOSURE

(75) Inventors: Lindsay Herman Davis, Raleigh, NC (US); Olav Marcus Aagaard, Rotterdam (NL); Katherine Campbell Glasgow, Wake Forest, NC (US); Nisha Amol Keskar, Wake Forest, NC (US); Meghann Moore Sparks, Franklinton, NC (US)

(73) Assignee: VINVENTIONS USA, LLC, Zebulon, NC (US)

( * ) Notice: Subject to any disclaimer, the term of this patent is extended or adjusted under 35 U.S.C. 154(b) by 1137 days.

(21) Appl. No.: 12/658,222

(22) Filed: Feb. 3, 2010

(65) Prior Publication Data

US 2010/0200606 A1 Aug. 12, 2010

Related U.S. Application Data

(60) Provisional application No. 61/207,418, filed on Feb. 11, 2009.

(51) Int. Cl.
*B65D 39/00* (2006.01)

(52) U.S. Cl.
CPC ..... *B65D 39/0029* (2013.01); *B65D 39/0011* (2013.01); *B65D 39/0058* (2013.01); *B65D 39/0076* (2013.01); *B65D 2539/008* (2013.01)

(58) Field of Classification Search
None
See application file for complete search history.

(56) References Cited

U.S. PATENT DOCUMENTS 4,392,581 A * 7/1983 Itsubo et al. ..... 215/348
5,904,965 A 5/1999 Noel et al.
6,709,724 B1 3/2004 Teumac et al.
2003/0161985 A1 8/2003 Lauer
2004/0176538 A1* 9/2004 Couturier ..... 525/100
2006/0006132 A1* 1/2006 Lauer et al. ..... 215/355
2006/0035074 A1* 2/2006 Taylor ..... 428/339

FOREIGN PATENT DOCUMENTS

EP 1942133 A1 * 7/2008
WO 9117044 A1 11/1991
WO 9847783 A1 10/1998

OTHER PUBLICATIONS

Canadian Office Action for Canadian patent application 2,752,174, dated Apr. 4, 2013, 2 pages.
First Office Action for Chinese patent application 201080012599.0 dated Feb. 27, 2013, 9 pages.
International Search Report and Written Opinion for International patent application PCT/EP2010/051575, dated Apr. 8, 2010, 7 pages.

* cited by examiner

*Primary Examiner* — Chinessa T Golden
(74) *Attorney, Agent, or Firm* — Withrow & Terranova, P.L.L.C.

(57) ABSTRACT

By providing a synthetic closure which comprises at least one thermoplastic polymer and, as an additive, at least one fatty acid derivative, in particular a fatty acid ester or a fatty acid amide such as a stearamide, a synthetic closure is attained which achieved substantially enhanced properties. In particular, it has been found that the oxygen transfer rate of the closure is reduced substantially, thus reducing unwanted oxidation of wine. Furthermore, the use of a fatty acid derivative additive improves the performance characteristics of synthetic corks, such as extraction force, ovality control, diameter control and length control.

43 Claims, 2 Drawing Sheets

SYNTHETIC CLOSURE

RELATED DATA

This application is related to U.S. Provisional Patent Application Ser. No. 61/207,418, filed Feb. 11, 2009 entitled SYNTHETIC CLOSURE.

TECHNICAL FIELD

This invention relates to closures or stoppers for containers containing liquids, low viscosity substrates, and small solids, and more particularly, to closures or stoppers formed from synthetic materials and employable as a bottle stopper for a container.

In particular, this invention relates to a synthetic closure having a reduced permeability to gases such as oxygen, hydrogen and carbon dioxide. Even more particularly, the invention relates to a synthetic closure having a reduced oxygen transfer rate (OTR) suitable for use as closures for wine bottles, thus preventing bottled wine from unwanted oxidation and spoilage and thereby improving the shelf life of the product.

BACKGROUND ART

In view of the wide variety of products that are sold for being dispensed from containers, particularly containers with round necks which define the dispensing portal, numerous constructions have evolved for container stoppers or closure means for the portals. Generally, products such as vinegar, vegetable oils, laboratory liquids, detergents, honey, condiments, spices, alcoholic beverages, and the like, impose similar requirements on the type and construction of the closure means used for containers for these products. However, wine sold in bottles represents the most demanding product for bottle closure means, due to the numerous and burdensome requirements placed upon the closure means used for wine bottles. In view of these demands, most wine bottle closures or stoppers have been produced from a natural material known as "cork".

Although synthetic materials have been proposed for use as wine bottle stoppers or closures, many of such products have been unable to satisfy all of the stringent requirements. As a result, cork has remained the dominant material for wine closures, in spite of the numerous inherent problems that exist with cork.

Cork represents the bark of a particular variety of cork oak, quercus suber, a tree of the oak family characteristic of western Mediterranean countries, such as Portugal, Spain, Algeria, Morocco, France, Italy, and Tunisia, that has the ability to renew its bark indefinitely. Cork is a vegetable plant comprising tissue made up of dead microcells, generally 14-sided polyhedrons, slotting in one against the other, with the intercell space filled with a gaseous mixture, essentially atmospheric air but without the carbon dioxide. It is estimated that 1 $cm^3$ of cork numbers 15 to 40 million hexagonal cells with the thickness of the cellular membranes varying between 1 and 2.5 microns.

The suberose texture is not arranged in a uniform fashion. It is crisscrossed within its thickness by pores or ducts with walls more or less lignified, forming the lenticels. These are filled with powder of a reddish-brown color, rich in tannin. The lenticels are permeable to gases and liquids and they are often invaded by molds and other microorganisms.

The unevenness, both in membrane thickness and in the height and diameter of the cell forming the suberose parenchyma, can affect some of the cork's mechanical and physical properties, namely its compressibility and elasticity. The cork oak being able to keep its physiological process active at all times, the difference in cell size and the thickness of the cellular membrane between cork produced in spring and the succeeding autumn leave discernible rings showing the extent of each year's growth.

The contents of newly formed cells disappear during growth and the subsequent process of suberization of the membranes, on completion of which all communication with the plant's living tissues ceases. The uniqueness of quercus suber is the achieved thickness of cork bark, up to several centimeters, which insulates the tree from heat and loss of moisture and protects it from damage by animals.

In order to harvest the thick cork bark for the first time, the growth cycle takes between 20 and 30 years, depending on location, weather conditions etc. yielding the so-called virgin cork. Afterwards, some 10 years are needed between each harvest of cork boards or reproduction cork in order to gain the necessary length or diameter for some corks. Due to this process, the cork used for the manufacture of bottle closures is a reproduction of cork that is formed again after several barking phases.

The properties of cork derive naturally from the structure and chemical composition of the membranes. Because 89.7% of the tissue consists of gaseous matter, the density of cork is extremely low, about 120 to 200 $kg/m^3$, which makes the cork light and a good insulator. Density differences can be explained by the humidity differences, the age and quality of the cork bark and the cork tree and its growth differences. The cellular membranes are very flexible, rendering the cork both compressible and elastic. Elasticity enables it to rapidly recover to its original dimensions after any deformation. Its chemical composition gives the cork the property of repelling moisture. The walls of the cells are crusted with suberin, a complex mixture of fatty acids and heavy organic alcohols.

The value of cork is further increased by its low conductivity of heat, sound and vibration due to the gaseous elements sealed in tiny, impervious compartments. Cork is also remarkably resistant to wear and has a high friction coefficient, thanks to the honeycomb structure of the suberose surface. Cork does not absorb dust and consequently does not cause allergies nor pose a risk to asthma sufferers. It is fire resistant, recyclable, environmentally friendly and a renewable product.

These advantages have made natural cork the preferred bottle closure for wine storage, particularly for medium and high quality wines where tradition, the wine mystique and the bottle opening ritual with a corkscrew, are a very important, though intangible, aspect of the wine consumption. However, numerous disadvantages of natural cork also exist and derive naturally from the structure and chemical composition of the membranes.

Because cork is a natural product, it is a limited resource. Its limitations become even more obvious with the following facts: the natural growing of cork is geographically limited to the western Mediterranean countries; the world wide annual harvest of cork oak bark is 500,000 tons and can barely be increased, because of climatic and ecological reasons; and ten-year cycles are needed between each harvest of cork boards. In order to meet the rising worldwide cork demand, the pare cycles of cork have been shortened, leading to inferior qualities and constantly rising raw material prices.

The irregularities of the cork's structure due to geographic, climatic and ecological reasons cause many quality variances. This creates a complex categorization of qualities and standards. Through different types of washing processes, various chemical agents are combined in order to decontaminate the cork and to treat the appearance of the cork. High quality corks do not need washing. The cork quality is graded, based on the number of lenticels, horizontal and vertical cracks, their sizes, and other cork specific characteristics. The grading process is a subjective task based on statistically significant populations which is difficult to perform due to its natural origin, since every cork looks, feels, functions and smells different.

Wine market experts estimate that 1% to 5% of all bottled wine is spoiled by cork taint. At least six chemical compounds have been associated with cork taint in wines. Most frequently, 2,4,6-trichloranisole (TCA) is the major culprit responsible for the offensive off-odor and impact on the flavor of the wine. TCA has an extremely low threshold for odor detection. It is detectable at concentrations as low as 1 ppt or 1.0 nanogram per liter.

In most cases, cork taint does not involve the wine-making process. Typically, the tainting chemical is not found in vineyards or in parts of the winery where the wine is produced. After the wine is bottled, the defect shows itself, thus spoiling the wine. It is almost exclusively associated with corks.

Also, there is evidence that once the corks have been treated with chlorine, and are brought into interaction with mold fungus through humidity, chloranisole is created. Other types of wine spoilage are caused by oxidation, hydrogen sulfide, volatile acidity, sulfur dioxide, brettanomyces, and mercaptans.

Another problem commonly found with natural cork is leaking bottles. Typically, the lack of tightness between the cork and the neck of the bottle causes 10% to 20% of bottle leakage. However, the majority of wine leakage is caused by passage of the wine through the cork body. These problems are most often found with lower quality cork material, which is typically porous, too soft, out of round, or out of the predetermined specifications.

In view of the fact that wine spoilage is often caused by oxidation of the wine, any gas exchange between ambient conditions and the interior of the wine bottle should be avoided. However, many corks are deformed by the chops or jaws of the bottle corking equipment, which enables air exchange and oxidation to occur. Furthermore, when bottles are stored in an environment where ideal humidity is not maintained, optimum functionality of the cork is not achieved and the cork loses its efficiency as a sealing medium by drying out, becoming brittle and/or losing its mechanical properties. These problems often cause the cork to break when pulled out of the bottle or enable wine spoilage to occur. In addition, natural cork absorbs liquids, depending on its structure and quality. This also results in breakage, while the cork is pulled out of the bottle.

Further problems or deficiencies found with natural cork are the propensity of cork worms to store or lay their eggs on the cork material, enabling the larvae to dig gullies into the cork. Consequently, enlarged apertures or channels are formed in the cork, unknown to the bottler, producing unwanted contamination and increased permeability. In addition to these drawbacks, cork powder and other cork impurities are often able to fall into the wine during the corking process, causing further problems for wine bottlers and unwanted surprises for the wine consumer.

In order to avoid some of the difficulties, bottlers have developed various spray coatings, such as paraffins, silicones and polymer materials, in an attempt to ease the movement of the cork into and out of the bottle, as well as to improve the permeability of the cork and fill imperfections in the cork surface. However, no ideal cork spray coating product has been developed to protect a wine corking member from all of the inherent difficulties or drawbacks of the material.

In particular, one of the principal difficulties to which any bottle closure is subjected in the wine industry is the manner in which the closure is inserted into the bottle. Typically, the closure is placed in a jaw clamping member positioned above the bottle portal. The clamping member incorporates a plurality of separate and independent jaw members which peripherally surround the closure member and are movable relative to each other to compress the closure member to a diameter substantially less than its original diameter. Once the closure member has been fully compressed, a plunger moves the closure means from the jaws directly into the neck of the bottle, where the closure member is capable of expanding into engagement with the interior diameter of the bottle neck and portal, thereby sealing the bottle and the contents thereof.

In view of the fact that the jaw members must be independent of each other and separately movable in order to enable the closure member to be compressed to the substantially reduced diameter, each jaw member comprises a sharp edge which is brought into direct engagement with the closure member when the closure member is fully compressed. Depending upon the composition of the closure member, score lines are frequently formed on the outer surface of the closure member, which prevents a complete, leak-free seal from being created when the closure member expands into engagement with the bottle neck.

Thus, any synthetic bottle closure must be able to withstand this conventional bottling and sealing method. Furthermore, many cork sealing members also incur damage during the bottling process, resulting in leakage or tainted wine.

Another problem inherent in the wine industry is the requirement that the wine stopper must be capable of withstanding a substantial pressure build up that occurs during the storage of the wine product after it has been bottled and sealed. Due to natural expansion of the wine during hotter months, pressure builds up, imposing a burden upon the bottle stopper that must be resisted without allowing the stopper to be displaced from the bottle. As a result, the bottle stopper employed for wine products must be capable of secure, intimate, frictional engagement with the bottle neck in order to resist any such pressure build up.

A further problem inherent in the wine industry is the requirement that secure, sealed engagement of the stopper with the neck of the bottle must be achieved virtually immediately after the stopper is inserted into the neck of the bottle. During normal wine processing, the stopper is compressed, as detailed above, and inserted into the neck of the bottle to enable the stopper to expand in place and seal the bottle. However, such expansion must occur immediately upon insertion into the bottle since many processors tip the bottle onto its side or neck down after the stopper is inserted into the bottle neck, allowing the bottle to remain stored in this position for extended periods of time. If the stopper is unable to rapidly expand into secure, intimate, frictional contact and engagement with the walls of the neck of the bottle, wine leakage will occur.

A further requirement imposed upon closures or stoppers for wine bottles is the requirement that the closure be removable from the bottle using a reasonable extraction force. Although actual extraction forces extend over a wide range, the generally accepted, conventional extraction force is typically below 100 pounds.

In achieving a commercially viable stopper or closure, a careful balance must be made between secure sealing and providing a reasonable extraction force for removal of the closure from the bottle. Since the requirements for these two characteristics are in direct opposition to each other, a careful balance must be achieved so that the stopper or closure is capable of securely sealing the wine in the bottle, preventing both leakage and gas transmission, while also being removable from the bottle without requiring an excessive extraction force.

Another requirement for commercially viable wine stoppers or closures is a low oxygen permeability. Too much oxygen can cause the premature spoilage of wine. In fact, oxidation occurs over a period of time to render the beverage undrinkable. Thus, it is necessary to effectively prevent oxygen from entering the bottle in order to extend and preserve the freshness and shelf life of the product. Any commercially viable wine stopper or closure should therefore have a low oxygen transfer rate (OTR).

Therefore, it is a principal object of the present invention to provide closure means for containers which is manufacturable from synthetic materials and effectively closes and seals any desired bottle, container, package and the like.

Another object of the present invention is to provide a synthetic closure having the characteristic features described above which is manufacturable on a continuing production basis, thus providing lower manufacturing costs compared to natural or synthetic (structured) closures and satisfying industry requirements for a removable bottle stopper which is producible substantially more economically than cork closure/stoppers.

Another object of the present invention is to provide a synthetic closure having the characteristic features described above which meets or exceeds the requisite physical characteristics found in natural closures or stoppers such as cork.

Another object of the present invention is to provide a synthetic closure or stopper having the characteristic features described above which is capable of being employed in conventional bottling equipment for being inserted into a bottle container without experiencing unwanted physical damage.

Another object of the present invention is to provide a synthetic closure or stopper having the characteristic features described above that can be substituted for a cork stopper in wine bottles, providing the desirable characteristics of conventional cork stoppers while also being removable from the bottle in the conventional manner without breaking.

Another object of the present invention is to provide a synthetic closure or stopper having the characteristic features described above, which is physiologically neutral, capable of being sterilized, as well as capable of being formed to visually simulate a desired classification of natural cork.

A further object of the present invention is to provide a synthetic closure or stopper having the characteristic features described above which is substantially odorless, remains substantially odorless in position, is substantially tasteless, and only absorbs limited amounts of water.

Another object of the present invention is to provide a synthetic closure or stopper having the characteristic features described above which is substantially unaffected by diluted acids and bases as well as substantially unaffected by most oils.

Another object of the present invention is to provide a synthetic closure or stopper having the characteristic features described above which has sufficient resistance to shrinkage, aging, apsorbtion of mold or fungus, damage from insects.

Another object of the present invention is to provide a synthetic closure or stopper having the characteristic features described above which can be mass produced on a continuing basis and eliminates the spoilage of wine due to cork taint.

Another object of the present invention is to provide a synthetic closure or stopper having the characteristic features described above which is capable of being removed from the container using conventional extraction forces, which forces remain reasonably constant regardless of the period of time over which the stopper has been in the bottle.

Another object of the present invention is to provide a synthetic closure or stopper having the characteristic features described above which is capable of being easily inserted into any desired bottle container, as well as being removed from the bottle or container without requiring excessive force.

Another object of the present invention is to provide a synthetic closure/stopper having the characteristic features described above which reduces the transfer or exchange of undesirable gases through the closure. In particular, it is an object of the present invention to provide a synthetic closure/stopper having a low oxygen transfer rate (OTR).

Other and more specific objects will in part be obvious and will in part appear hereinafter.

SUMMARY OF THE INVENTION

In accordance with the present invention a synthetic closure is provided which comprises at least one thermoplastic polymer and, as an additive, at least one fatty acid derivative, in particular a fatty acid ester or a fatty acid amide such as a stearamide.

With the present invention it is possible to provide a synthetic closure that has a foam density of less than about 350 kg/m$^3$, in particular less than about 300 kg/m$^3$, and—at the same time—an oxygen transfer rate (OTR) as determined by Mocon measurement using 100% oxygen of less than about 0.025 cc/day/closure, in particular less than about 0.015 cc/day/closure.

In fact, the inventors of the present invention have found that the addition of at least one fatty acid derivative to the polymer composition of the synthetic closure imparts superior properties to the synthetic closure. In particular, it was found that the oxygen transfer rate of the closure can be reduced substantially, thus reducing unwanted oxidation of wine. Furthermore, it was found that the use of fatty acid derivative additive does not have a negative impact on the performance characteristics of synthetic corks such as extraction force, ovality control, diameter control and length control.

In order to impart the desired OTR reducing effect to the closure, the fatty acid derivative is typically used in a concentration from about 0.01 to about 10 wt. %, in particular from about 0.1 to about 5 wt. %, more particularly from about 1 to about 3 wt. %, based on the total weight of thermoplastic polymer.

By employing the present invention, many of the difficulties and drawbacks found in the prior art have been overcome and a mass producible, resilient, synthetic bottle closure is realized by achieving a synthetic, extruded, foamed polymer core peripherally surrounded and integrally bonded with one or more cooperating, synthetic, separate, independent, extruded, outer layers or skin members. The present invention can be employed on any desired product, whether the product is a liquid, a viscous material, or a solid distributed in a bottle or container and dispensed through the open portal of the container neck.

As will become evident from the following detailed disclosure, the synthetic closure of the present invention may be employed as a bottle closure or stopper for any desired product. However, for the reasons detailed above, wine products impose the most burdensome standards and requirements on a bottle closure. Consequently, in order to clearly demonstrate the universal applicability of the synthetic closure of the present invention, the following disclosure focuses on the applicability and usability of the synthetic closure of the present invention as a closure or stopper for wine containing bottles. However, this discussion is for exemplary purposes only and is not intended as a limitation of the present invention.

As discussed above, a bottle closure or stopper for wine must be capable of performing numerous separate and distinct functions. One principal function is the ability to withstand the pressure build up due to temperature variations during storage, as well as prevent any seepage or leakage of the wine from the bottle. Furthermore, a tight seal must also be established to prevent unwanted gas exchange between ambient conditions and the bottle interior, so as to prevent any unwanted oxidation or permeation of gases from the wine to the atmosphere. In addition, the unique corking procedures employed in the wine industry also impart substantial restrictions on the bottle closure, requiring a bottle closure which is highly compressible, has high immediate compression recovery capabilities and can resist any deleterious effects caused by the clamping jaws of the bottle closure equipment.

Although prior art synthetic products have been produced in an attempt to satisfy the need for alternate bottle closures employable in the wine industry, such prior art systems have often been found incapable of meeting all of the stringent requirements and demands imposed upon a bottle closure for wine products. However, by employing the present invention, many of the prior art inabilities have been obviated and an effective, easily employed, mass-produced synthetic closure has been realized. In the present invention, many of the prior art problems have been overcome by achieving a synthetic closure for a product retaining container constructed for being inserted and securely retained in a portal forming neck of said container, wherein the closure comprises at least one thermoplastic polymer and at least one fatty acid derivative.

The fatty acid derivative can, for example, be selected from the group consisting of fatty acid esters and fatty acid amides. In particular, the fatty acid derivative can be a derivative of a saturated or unsaturated fatty acid having from about 12 to about 45, in particular from 25 to 38 carbon atoms. Fatty acid amides suitable for use in the present invention comprise, for example, an N-substituted fatty acid amide and/or a saturated fatty acid bis-amide or mixtures thereof. Suitable fatty acid derivatives include, in particular, lauramide, palmitamide, arachidamide, behenamide, stearamide, 12-hydroxystearamide, oleamide, erucamide, recinoleamide, N-stearyl stearamide, N-behenyl behenamide, N-stearyl behenamide, N-behenyl stearamide, N-oleyl oleamide, N-oleyl stearamide, N-stearyl oleamide, N-stearyl erucamide, erucyl stearamide, erucyl erucamide, N-oleyl palmitamide, methylol stearamide, methylol behenamide, methylene bis-stearamide, ethylene bis-stearamide, ethylene bis-isostearamide, ethylene bis-hydroxystearamide, ethylene bis-behenamide, hexamethylene bis-stearamide, hexamethylene bis-behenamide, hexamethylene bis-hydroxystearamide, N,N'-distearyl adipamide, and N,N'-distearyl sebacamide, ethylene bis-oleamide, hexamethylene bis-oleamide, N,N'-dioleyl adipamide, N,N'ethylenebis(stearamide), N,N'ethylenebispalmitamide, glycerol mono stearate, and/or N,N'-dioleylsebacamide, or mixtures thereof.

Particularly well suited fatty acid derivatives for use in the present invention include ethylenebis(stearamide) and ethylenebis(palmitamide), or mixtures thereof. In this regard, a mixture of ethylenebis(stearamide) and ethylenebis(palmitamide) in a ratio of between about 1:9 to about 9:1 by weight, is particularly preferred.

In accordance with the present invention, the use of fatty acid derivatives can be applied to any kind of synthetic closure comprising a thermoplastic polymer, regardless of its shape, composition and structure. In particular, the use of fatty acid derivatives in accordance with the present invention can be applied to cylindrically shaped synthetic closures for wine bottles manufactured by various methods such as, for example, injection molding, mono-extrusion, co-extrusion and/or cross-head extrusion. According to a preferred embodiment of the invention, the thermoplastic polymer is at least partially foamed. On the other hand, it should be appreciated that the underlying idea of the present invention can be applied to unfoamed closures as well. Furthermore, the synthetic closure of the present invention preferably has a layered structure, i.e. it can, for example, comprise a foamed core member and a peripheral layer cylindrically enveloping the core member. It should be noted, however, that the synthetic closure of the present invention may also comprise only one single component (e.g. a foamed, partially foamed or unfoamed cylindrically shaped body made from thermoplastic material) without any additional layers.

According to a preferred embodiment of the invention the synthetic bottle closure of the present invention comprises, as its principal component, a core member which is formed from extruded, foamed, plastic polymers, copolymers, or homopolymers. Although any known foamable plastic material can be employed in the extrusion process for developing the bottle closure of the present invention, the plastic material must be selected for producing physical properties similar to natural cork, so as to be capable of providing a synthetic closure for replacing natural cork as a closure for wine bottles. Preferably, the plastic material for the core member is a closed cell plastic material. Suitable plastic materials for the core member are, for example, polyethylenes, metallocene catalyst polyethylenes, polybutanes, polybutylenes, polyurethanes, silicones, vinyl-based resins, thermoplastic elastomers, polyesters, ethylenic acrylic copolymers, ethylene-vinyl-acetate copolymers, ethylene-methyl-acrylate copolymers, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers of polypropylene, copolymerizable ethylenically unsaturated commoners and/or mixtures thereof. A particularly preferred plastic material for the core element is polyethylene, in particular LDPE, and/or ethylene-vinyl-acetate copolymer (EVA). Preferably, the density of the core member in the final product is between about 100 to about 500 $kg/m^3$, in particular between about 200 to about 350 $kg/m^3$ or between about 250 to about 420 $kg/m^3$. Preferably, in the final product, the cell size of the core member is preferably substantially homogeneous throughout its entire length and diameter.

Depending upon the sealing process employed for inserting the synthetic closure of the present invention in a desired bottle, additives, such as slip additives, may be incorporated into the outer, peripherally surrounding layer of the synthetic closure of the present invention to provide lubrication of the synthetic closure during the insertion process. In addition, other additives typically employed in the bottling industry may also be incorporated into the synthetic closure of the present invention for improving the sealing engagement of the synthetic closure with the bottle as well as reducing the extraction forces necessary to remove the synthetic closure from the bottle for opening the bottle.

According to one embodiment of the present invention, a unique synthetic bottle closure is realized by forming an outer layer peripherally surrounding the core member in intimate, bonded, interengagement therewith. The outer, peripheral layer of the synthetic closure is formed from foam or non-foam plastic material. However, the outer peripherally surrounding layer is formed with a substantially greater density in order to impart desired physical characteristics to the synthetic bottle closure of the present invention. Preferably, the peripheral layer is formed from one or more of the following plastic materials: thermoplastic polyurethanes, thermoplastic olefins, thermoplastic vulcanizates, flexible polyolefins, fluoroelastomers, fluoropolymers, polyethylenes, styrene butadiene block copolymers, thermoplastic elastomers, polyether-type polyurethanes and/or mixtures or blends thereof. A particularly preferred plastic material for the peripheral layer is polypropylene, EPDM, and/or polystyrene. If desired, the peripheral layer can be formed from a transparent plastic material Preferably, the plastic material selected for the peripheral layer is different from that of the core member. Furthermore, the density of the peripheral layer in the final product is preferably about 300 to about 1500 kg/m$^3$, in particular about 505 to about 1250 kg/m$^3$, and most preferred about 750 to about 1100 kg/m$^3$.

In accordance with a preferred embodiment of the present invention, a continuous manufacturing operation is provided wherein the core member of the synthetic closure is formed by a continuous extrusion process which enables the core to be manufactured as an elongated, continuous length of material.

Furthermore, in accordance with the present invention, an outer layer or skin surface can be formed about the central core. In this way, the elongated length of material is produced in a continuous production operation enabling all production steps to be completed prior to the formation of the individual synthetic closure members by cutting the elongated length of extruded material in the desired manner.

By achieving a synthetic closure in accordance with the present invention, a bottle closure is realized which is capable of satisfying all requirements imposed thereon by the wine industry, as well as any other bottle closure/packaging industry. As a result, a synthetic bottle closure is attained that can be employed for completely sealing and closing a desired bottle for securely and safely storing the product retained therein, with desired markings and/or indicia printed thereon.

The invention accordingly comprises an article of manufacture possessing the features, properties, and relation of elements which will be exemplified in the article hereinafter described, and the scope of the invention will be indicated in the claims.

THE DRAWINGS

For a fuller understanding of the nature and objects of the invention herein described, reference should be had to the following detailed description taken in connection with the accompanying drawings, in which.

DETAILED DESCRIPTION

Figure 1:
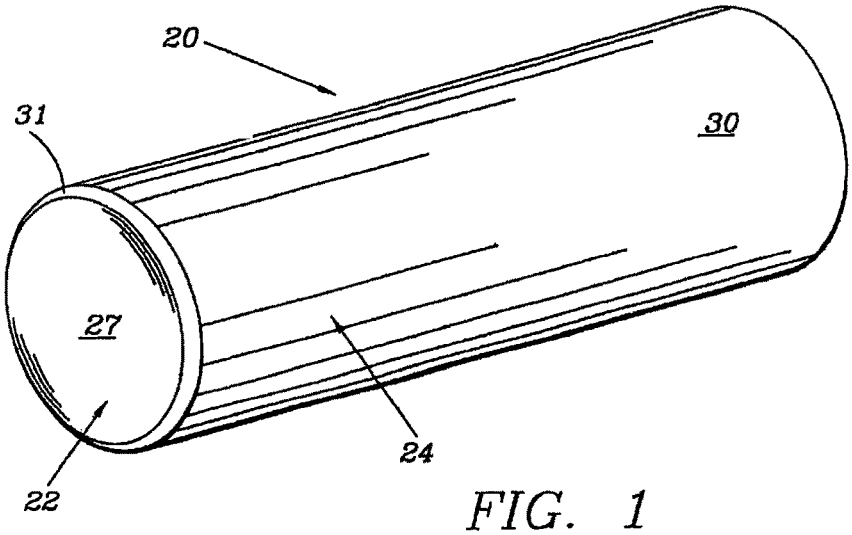
FIG. 1 is a perspective view of a synthetic closure according to an embodiment of the present invention.
Figure 2:
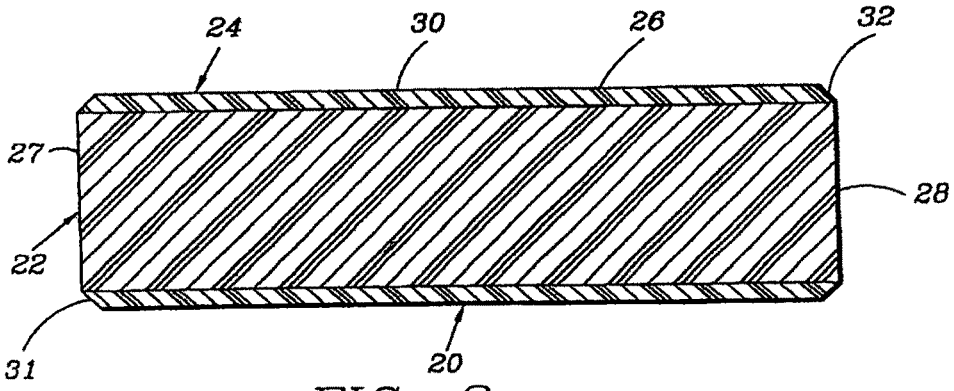
FIG. 2 is a cross sectional-side elevation of a synthetic closure according to an embodiment of the present invention.
Figure 3:
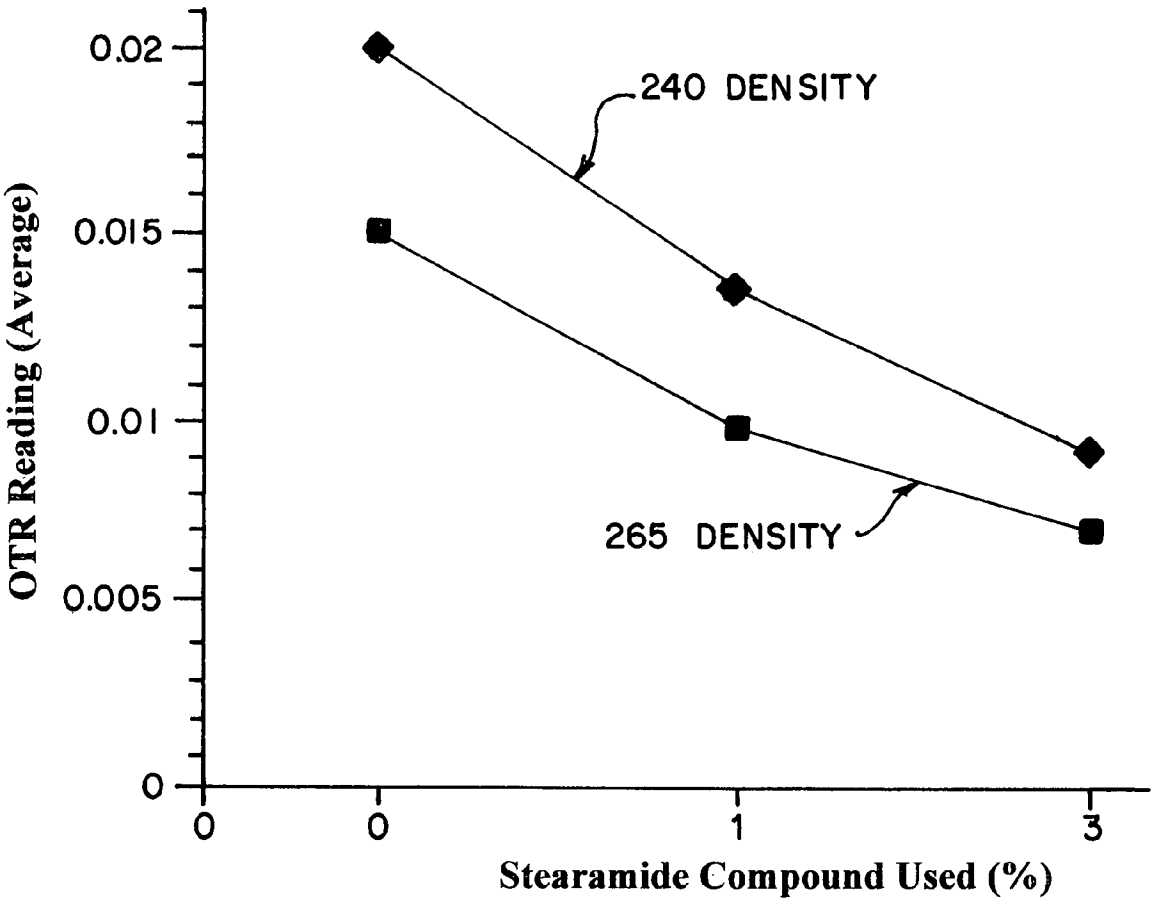
FIG. 3 is a test data diagram depicting the oxygen transfer rate of synthetic closures in dependence of the fatty acid derivative additive concentration in the composition of the closure.

By referring to FIGS. 1 to 3, along with the following detailed disclosure, the construction and production method for the synthetic closures of the present invention can best be understood. In these Figures, as well as in the following detailed disclosure, the synthetic closure of the present invention, and its method of production, is depicted and discussed as a bottle closure for wine products. However, as detailed above, the present invention is applicable as a synthetic closure for use in sealing and retaining any desired product in any desired closure system. However, due to the stringent and difficult demands and requirements placed upon closures for wine products, the following detailed disclosure focuses upon the applicability of the synthetic bottle closures of the present invention as a closure for wine bottles. However, it is to be understood that this detailed discussion is provided merely for exemplary purposes and is not intended to limit the present invention to this particular application and embodiment.

In FIG. 1, the preferred construction of a synthetic closure 20 is depicted comprising a generally cylindrical shape formed by core member 22 and outer layer or skin layer 24 which peripherally surrounds and is intimately bonded to core member 22. In the preferred embodiment, core member 22 comprises a substantially cylindrically shaped surface 26, terminating with substantially flat end surfaces 27 and 28. Whereas such layered structure is generally preferred, it should be appreciated that the closures of the present invention are not restricted to such layered products. It should be noted, however, that the synthetic closure of the present invention may also comprise only one single component (e.g. a foamed, partially foamed or unfoamed cylindrically shaped body made from thermoplastic material) without any additional layers. Whenever applicable, the following detailed description of a synthetic closure having a layered structure (i.e. a core member and at least one outer layer) shall also apply to such single component synthetic closures.

In a preferred embodiment, outer layer or skin layer 24 is intimately bonded directly to core member 22, peripherally surrounding and enveloping surface 26 of core member 22. Outer layer or skin layer 24 incorporates exposed surface 30, which comprises a substantially cylindrical shape and forms the outer surface of synthetic bottle closure 20 of the present invention, along with flat end of surfaces 27 and 28.

In order to assist in assuring entry of synthetic bottle closure 20 into the portal of the bottle into which closure 20 is inserted, terminating edge 31 of peripheral layer 24 may be beveled or chamfered. Similarly, terminating edge 32 of peripheral layer 24 also may comprise a similar bevel or chamfer. Although any desired bevel or chamfered configuration can be employed, such as a radius, curve, or flat surface, it has been found that merely cutting ends 31 and 32 with an angle of about 45, the desired reduced diameter area is provided for achieving the desired effect.

By incorporating chamfered or beveled ends 31 and 32 on synthetic bottle closure 20, automatic self-centering is attained. As a result, when synthetic bottle closure 20 is compressed and ejected from the compression jaws into the open bottle for forming the closure thereof, synthetic bottle closure 20 is automatically guided into the bottle opening, even if the clamping jaws are slightly misaligned with the portal of the bottle. By employing this configuration, unwanted difficulties in inserting bottle closure 20 into any desired bottle are obviated. However, in applications which employ alternate stopper insertion techniques, chamfering of ends 31 and 32 may not be needed. Further, in order to facilitate the insertion of the closure into the bottle neck, the outer surface can fully or partly be coated with suitable lubricants, in particular with silicones.

In order to produce the attributes required for use in the wine industry, core 22 is formed from foam plastic material using a continuous extrusion process. Although other prior art systems have employed molded foamed plastic material, these processes have proven to be more costly and incapable of providing a final product with the attributes of the present invention.

As described above, the thermoplastic polymer employed for producing the synthetic closure of the invention contains, as an additive, a fatty acid derivative, in particular a fatty acid ester and/or a fatty acid amide. In the case of the multi-layer, multi-component synthetic closure depicted in FIGS. 1 and 2, such additive is admixed to the polymer composition of the core member and/or the peripheral layer. According to a preferred embodiment of the invention, the fatty acid derivative additive is added to the polymer composition of the core member. However, it can also be envisioned that the fatty acid derivative additive is added to the composition of both the core member and the peripheral layer.

The fatty acid esters and fatty acid amides of this invention are derivatives of saturated and unsaturated normal fatty acids having from about fourteen to about thirty-six carbon atoms, inclusive. Representative fatty acids are, for example, tetradecanoic, pentadecanoic, hexadecanoic, heptadecanoic, octadecanoic, nonadecanoic, eicosanoic, henecosanoic, decosanoic, tricosanoic, tetracosanoic, pentacosanoic, hexacosanoic, triacontanoic, hentriacontanoic, dotriacontanoic, tetratriacontanoic, pentatriacontanoic, hexatriacontanoic acids, myristic, palmitic, stearic, arachidic, behenic and hexatrieisocontanoic ($C_{36}$) acids, palmitoleic, oleic, linolenic and cetoleic, and the like.

The methods of preparation of fatty acid esters and fatty acid amides employed are generally known in the art. For example, fatty acid esters are commonly prepared by the reaction of an alcohol and a fatty acid or a fatty acid derivative, such as a fatty acid halide. Polyols are also useful to prepare fatty acid polyesters as are the corresponding polyamines to prepare fatty acid polyamides. Representative polyols are ethylene glycol, 1,3-propanediol, 1,4-butanediol, 1,5-pentanediol 1,6-hexanediol, a polyglycol such as diethylene glycol, triethylene glycol, dipropylene glycol, dibutylene glycol, trimethylene glycol, isobutylene-ethylene glycol, trimethylene glycol; the monoethyl, monopropyl or monobutyl ethers of glycerol, dicyclopentadienyl dimethanol, pentaerythritol, dipentaerythritol, tripentaerythritol, trimethylolpropane, trimethylolethane, etc., glycerol, glycerol mono-acetate, mannitol, sorbitol, xylose, and the like, or mixtures thereof.

Suitable fatty amides include, for example, saturated fatty acid monoamide (preferably, lauramide, palmitamide, arachidamide behenamide, stearamide, 12 hydroxy stearamide); unsaturated fatty acid monoamide (preferably, oleamide, erucamide, recinoleamide); and N-substituted fatty acid amide (more preferably, N-stearyl stearamide, N-behenyl behenamide, N-stearyl behenamide, N-behenyl stearamide, N-oleyl oleamide, N-oleyl stearamide, N-stearyl oleamide, N-stearyl erucamide, erucyl erucamide, and erucyl stearamide, N-oleyl palmitamide, methylol amide (more preferably, methylol stearamide, methylol behenamide); saturated fatty acid bis-amide (more preferably, methylene bis-stearamide, ethylene bis-stearamide, ethylene bis-isostearamide, ethylene bis-hydroxystearamide, ethylene bis-behenamide, hexamethylene bis-stearamide, hexamethylene bis-behenamide, hexamethylene bis-hydroxystearamide, N,N'-distearyl adipamide, N,N'-distearyl sebacamide); unsaturated fatty acid bis-amide (more preferably, ethylene bis-oleamide, hexamethylene bis-oleamide, N,N'-dioleyl adipamide, N,N'-dioleyl sebacamide; saturated or unsaturated fatty acid tetra amide, stearyl erucamide, ethylene bis stearamide and ethylene bis oleamide.

A large number of useful fatty amides are commercially available from Humko Chemical Company, Memphis, Tenn. under the Kemamide tradename and include, for example, Kemamide B (behenamide/arachidamide), Kemamide W40 (N,N'-ethylenebisstearamide), Kemamide P181 (oleyl palmitamide), Kemamide S (stearamide), Kemamide U (oleamide), Kemamide E (erucamide), Kemamide O (oleamide), Kemamide W45 (N,N'-ethylenebisstearamide), Kenamide W20 (N,N'-ethylenebisoleamide), Kemamide E180 (stearyl erucamide), Kemamide E221 (erucyl erucamide), Kemamide S180 (stearyl stearamide), Kemamide S221 (erucyl stearamide), and the like. In addition, useful fatty amides are commercially available from Croda Universal Ltd., Hull East Yorkshire, England, under the Crodamide tradename and include, for example, Crodamide OR (oleamide), Crodamide ER (erucamide), Crodamide SR (stereamide), Crodamide BR (behenamide), Crodamide 203 (oleyl palmitamide), Crodamide 212 (stearyl erucamide), and the like.

In a preferred embodiment, core member 22 is formed as an extruded, medium or low density closed cell foamed plastic comprising one or more plastics selected from the group consisting of inert polymers, homopolymers, and copolymers.

The preferred thermoplastic polymer is preferably selected from the group consisting of polyethylenes, metallocene catalyst polyethylenes, polybutanes, polybutylenes, polyurethanes, silicones, vinyl based resins, thermoplastic elastomer, polyesters, ethylene acrylic copolymers, ethylene-vinyl-acetate copolymers, ethylene-methyl acrylate copolymers, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers of polypropylene and copolymerizable ethylenically unsaturated commoners, as well as ethylenic acrylic copolymers, ethylene-vinyl-acetate copolymers, ethylene-methyl-acrylate copolymers, thermoplastic polyurethanes, thermoplastic olefins, olefin block copolymers, thermoplastic vulcanizates, flexible polyolefins, fluorelastomers, fluoropolymers, polyethylenes, teflons (polytetrafluoroethylenes), ethylene-butyl-acrylate copolymers, ethylene-propylene-rubber ethylene-ethyl-acrylic copolymers and blends thereof. Furthermore, if a polyethylene is employed, it has been found that the polyethylene may comprise one or more polyethylenes selected from the group consisting of high density, medium density, low density, linear low density, ultra high density, and medium low density.

More particularly, the thermoplastic polymer is preferably selected from the group consisting of polyethylenes, metallocene catalyst polyethylenes, polybutanes, polybutylenes, polyurethanes, silicones, vinyl/based resins, thermoplastic elastomers, polyesters, ethylenic acrylic copolymers, ethylene-vinyl-acetate copolymers, ethylene-methyl-acrylate copolymers, thermoplastic polyurethanes, thermoplastic olefins, thermoplastic vulcanizates, flexible polyolefins, fluoroelastomers, fluoropolymers, polyethylenes, polytetrafluoroethylenes, and blends thereof, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers, ionomers, polypropylenes, and copolymers of polypropylene and copolymerizable ethylenically unsaturated comonomers, olefin block polymers, and mixtures thereof.

Regardless of the foamable plastic material selected for forming core member 22, the resulting extruded foam product preferably has a density ranging between about 100 kg/m$^3$ to 500 kg/m$^3$. Although this density range has been found to provide an effective core member, the density of the extruded foam core member 20 preferably ranges between about 200 kg/m$^3$ to 350 kg/m$^3$.

Since core member 22 is preferably substantially closed cell in structure, additives can intermixed with the plastic material to form a closed cell foam. The resulting core member 22 of the present invention preferably has average cell sizes ranging from between about 0.02 millimeters to 0.50 millimeters and/or a cell density ranging between about 25,000,000 cells/cm$^3$ to 8,000 cells/cm$^3$. Although this cell configuration has been found to produce a highly effective product, it has been found that the most desirable product possesses an average cell size ranging between about 0.05 and 0.1 millimeters with a cell density ranging between about 8,000,000 cells/cm$^3$ to 1,000,000 cells/cm$^3$. Furthermore, in order to assure that core member 22 possesses inherent consistency, stability, functionality and capability of providing long-term performance, the cell size of core member 22 is preferably homogeneous throughout its entire length and diameter. According to a preferred embodiment of the invention, the foam has a cell size characterized by a range of between about 0.025 mm minimum and about 0.5 mm maximum, in particular between about 0.05 mm minimum to about 0.35 mm maximum.

In order to control the cell size of core member 22 and attain the desired cell size detailed above, a nucleating agent can be employed. In the preferred embodiment, it has been found that by employing a nucleating agent selected from the group consisting of calcium silicate, talc, clay, titanium oxide, silica, barium sulfate, diatomaceous earth, and mixtures of citric acid and sodium bicarbonate, the desired cell density and cell size is achieved.

In this regard, it has been found that cell size and cell density is most advantageously realized in the formation of core member 22 by employing between about 0.1 and 5 parts by weight of the nucleating agent for every 100 parts by weight of the plastic foam. In this way, the desired physical characteristics of core member 22 are realized along with the desired control of the cell size and cell density. This leads to product consistency currently not available with natural materials.

As is well known in the industry, a blowing agent can be employed in forming extruded foam plastic material. In the present invention, a variety of blowing agents can be employed during the extruded foaming process whereby core member 22 is produced. Typically, either physical blowing agents or chemical blowing agents are employed. Suitable blowing agents that have been found to be efficacious in producing the core member of the present invention comprise one or more selected from the group consisting of: aliphatic hydrocarbons having 1-9 carbon atoms, halogenated aliphatic hydrocarbons having 1-9 carbon atoms and aliphatic alcohols having 1-3 carbon atoms. Aliphatic hydrocarbons include methane, ethane, propane, n-butane, isobutane, n-pentane, isopentane, neopentane, and the like. Among halogenated hydrocarbons and fluorinated hydrocarbons they include, for example, methylfluoride, perfluoromethane, ethyl fluoride, 1,1-difluoroethane (HFC-152a), 1,1,1-trifluoroethane (HFC-430a), 1,1,1,2-tetrafluoroethane (HFC-134a), pentafluoroethane, perfluoroethane, 2,2-difluoropropane, 1,1,1-trifluoropropane, perfluoropropane, perfluorobutane, perfluorocyclobutane. Partially hydrogenated chlorocarbon and chlorofluorocarbons for use in this invention include methyl chloride, methylene chloride, ethyl chloride, 1,1,1-trichlorethane, 1,1-dichloro1-fluoroethane (HCFC-141b), 1-chloro1,1-difluoroethane (HCFC-142b), 1,1-dichloro-2,2,2-trifluoroethane (HCFC-123) and 1-chloro-1,2,2,2-tetrafluoroethane (HCFC-124). Fully halogenated chlorofluorocarbons include trichloromonofluoromenthane (CFC11), dichlorodifluoromenthane (CFC-12), trichlorotrifluoroethane (CFC-113), dichlorotetrafluoroethane (CFC-114), chloroheptafluoropropane, and dichlorohexafluoropropane. Fully halogenated chlorofluorocarbons are not preferred due to their ozone depiction potential. Aliphatic alcohols include methanol, ethanol, n-propanol and isopropanol. Suitable inorganic blowing agents useful in making the foam of the present invention include carbon dioxide, nitrogen, carbon, water, air, nitrogen, helium, and argon.

Chemical blowing agents include azodicarbonamic, azodiisobutyro-nitride, benzenesulfonhydrazide, 4,4-oxybenzene sulfonylsemicarbazide, p-toluene sulfonylsemicarbazide, barium azodicarboxlyate, N,N'-Dimethyl-N,N'-dinitrosoterephthalamide, trihydrazinotriazine, and hydrocerol Preferably, in order to produce the desired product, the blowing agent is incorporated into the plastic melt in a quantity ranging between about 0.005% to 10% by weight of the weight of the plastic material.

As detailed above, either a physical blowing agent or a chemical blowing agent can be employed as part of the manufacturing process for forming core member 22 of the present invention. However, it has been found that the selection of a physical blowing agent is preferred since physical blowing agents allow core member 22 of synthetic bottle closure 20 to be achieved with a lower density, which is closer to natural cork.

In this regard, a blowing agent which is inert is preferred. Although any desired inert blowing agent may be employed, the blowing agent is preferably selected from the group consisting of nitrogen, carbon dioxide, sulphur dioxide, water, air, nitrogen, helium, and argon. In addition, hydrocarbons can be employed as the blowing agent which are preferably selected from the group consisting of butane, isobutene, pentane, isopentane and propane.

In addition to attaining core member 22 which possesses a construction with physical characteristics similar to nature cork, the synthetic bottle closure 20 of the present invention can also comprise a peripheral layer 24. The peripheral layer 24 is of particular importance in attaining synthetic bottle closure 20 which is capable of meeting and exceeding all of the difficult requirements imposed upon a closure or stopper for the wine industry.

As discussed above, the wine industry incorporates corking machines which incorporate a plurality of cooperating, movable jaws which move simultaneously to compress the bottle stopper to a diameter substantially smaller than the diameter of the portal into which the stopper is inserted. Then, once fully compressed, the stopper is forced out of the jaws directly into the bottle, for expanding and immediately closing and sealing the bottle.

Due to the operation of the cooperating jaws which are employed to compress the stopper for insertion into the bottle, sharp edges of the jaw members are forced into intimate contact with the outer surface of the stopper. Although cork material has been successful in resisting permanent damage from the jaw edges in most instances, other prior art synthetic stoppers have been incapable of resisting these cutting forces. As a result, longitudinal cuts, score lines or slits are formed in the outer surface of the stopper, enabling liquid to seep from the interior to the exterior of the bottle.

This inherent problem, existing with prior art cork and synthetic closures, can be eliminated by incorporating peripheral layer 24 which surrounds and envelopes substantially the entire outer surface 26 of core member 22. In addition, by forming peripheral layer 24 from high density, rugged, score-resistant material, synthetic bottle closure 20 overcomes all of the prior art difficulties and achieves a bottle closure having physical properties equal to or superior to conventional cork material.

In the preferred embodiment, peripheral layer 24 is formed from plastic material identical or similar to the plastic material employed for core member 22. However, as detailed below, the physical characteristics imparted to peripheral layer 24 differ substantially from the physical characteristics of core member 22.

In the preferred construction, peripheral layer 24 has a thickness ranging between about 0.05 and 5 millimeters and, more preferably, between about 0.1 and 2 millimeters. Although these ranges have been found to be efficacious to producing synthetic bottle closure 20 which is completely functional and achieves all of the desired goals, the preferred embodiment for wine bottles comprises a thickness of between about 0.1 and 1 millimeter.

In producing peripheral layer 24 and achieving the desired tough, score and mar-resistant surface for core member 22, peripheral layer 24 preferably comprises a density ranging between about 300 $kg/m^3$ to 1,500 $kg/m^3$. Most ideally, it has been found that the density of peripheral layer 24 ranges between about 750 $kg/m^3$ to 1100 $kg/m^3$.

In accordance with the present invention, the synthetic bottle closure 20 of the present invention should preferably be formed with peripheral layer 24 intimately bonded to substantially the entire surface 26 of core member 22. If any large unbonded areas exist, flow paths for gas and liquid could result. Consequently, secure, intimate, bonded interengagement of peripheral layer 24 with core member 22 is required for attaining a bottle closure for the wine industry.

In order to achieve this integral bonded interconnection between peripheral layer 24 and core member 22, peripheral layer 24 is formed about core member 22 in a manner which assures intimate bonded engagement. Preferably, the desired secure, intimate, bonded, interengagement is attained by simultaneous co-extrusion of core member 22 and peripheral layer 24 or by applying peripheral layer 24 to core member 22 after core member 22 has been formed. By employing either process, intimate bonded interengagement of peripheral layer 24 to core member 22 is attained.

By using equipment well known in this industry, the synthetic bottle closure 20 of the present invention can be produced by co-extruding core member 22 simultaneously with peripheral layer 24 to provide a final product wherein peripheral layer 24 is intimately bonded to core member 22 in a single, continuous operation. If co-extrusion process is employed, once the continuous elongated co-extruded layers forming synthetic bottle closure 20 have been completely formed and are ready for final processing, the elongated dual component material produced is cut to the precise length desired for forming synthetic bottle closures 20.

After each bottle closure 20 has been formed with the desired length, the desired chamfer, if needed, is formed at each end of peripheral layer 24 in order to provide the benefits detailed above. Once the chamfer or radius has been achieved, synthetic bottle closure 20 is ready for distribution to the desired consumer, unless appropriate coatings and/or printing will be applied. Preferably, closure 20 is coated with a suitable lubricant (e.g. silicone coating) before distribution to the desired consumer.

In the alternate construction, core member 22 is formed as an elongated, continuous, extruded foam product and is cooled or allowed to cool until ready for subsequent processing. Then, whenever desired, the continuous elongated length forming core member 22 is fed through a cross-head machine which enables peripheral layer 24 to be formed and positioned in the desired location peripherally surrounding core member 22 in intimate bonded interengagement therewith. Once the dual component product has been completed, the elongated length of material is cut to the desired length for forming bottle closure 20, as detailed above, with the desired chamfer or radius being formed in peripheral layer 24, attaining the final product.

In a further alternate embodiment, synthetic bottle closure 20 of the present invention is formed by employing generally conventional injection molding techniques. As is well known, injection molding is a manufacturing process where plastic is forced into a mold cavity under pressure. The mold cavity is essentially a negative of the part being produced, and the cavity is filled with plastic, and the plastic changes phase to a solid, resulting in a positive. Typically, injection pressures range from 5,000 to 20,000 psi. Because of the high pressures involved, the mold must be clamped shut during injection and cooling.

By employing this process, a plurality of separate and independent bottle closures 20 can be simultaneously formed in a multi-cavity mold having the precisely desired shape and configuration. Consequently, if beveled or chamfered edges are desired, the desired configuration is incorporated into the mold, thereby producing a product with the final shaped desired.

Typically, injection molding is employed to produce products having a single composition. However, if desired core member 22 may be formed with outer peripheral layer 24 surrounding and intimately bonded thereto using alternate techniques such as multi-step molding and multi-component molds, or subsequent coating operations, such as spray coating, tumble coating, or immersion coating. By employing these procedures, synthetic bottle closures 20 of the present invention are formed in an injection molding process, as desired, achieving the unique synthetic bottle closure of the present invention.

As discussed above, intimate bonded interengagement of peripheral layer 24 to core member 22 is required for providing a synthetic bottle closure 20 capable of being used in the wine industry. In this regard, although it has been found that the processes detailed above provide secure intimate bonded interengagement of peripheral layer 24 to core member 22, alternate layers or bonding chemicals can be employed, depending upon the particular materials used for forming core member 22 and peripheral layer 24.

If desired, well known bonding agents or tie layers can be employed on the outer surface of core member 22 in order to provide secure intimate bonded interengagement of peripheral layer 24 therewith. If a tie layer is employed, the tie layer would effectively be interposed between core member 22 and peripheral layer 24 to provide intimate bonded interengagement by effectively bonding peripheral layer 24 and core member 22 to the intermediately positioned tie layer. However, regardless of which process or bonding procedure is employed, all of these alternate embodiments are within the scope of the present invention.

As detailed above, a wide variety of plastic materials can be employed to produce the extruded synthetic bottle closure 20 of the present invention. Although each of the plastic materials detailed herein can be employed for both core member 22 and peripheral layer 24, the preferred plastic material for forming both core member 22 and peripheral layer 24 comprises one or more selected from the group consisting of medium density polyethylenes, low density polyethylenes, metallocene catalyst polyethylenes, polypropylenes, polyesters, ethylene-butyl-acrylate copolymers, vinyl-acetate copolymers, ethylene-methyl acrylate copolymers, styrene block copolymers, olefin block copolymers, and blends of these compounds.

It has also been discovered that the outer peripheral layer or skin layer 24 may comprise a thermoplastic composition which differs from the thermoplastic composition employed for the core member. In this regard, the outer peripheral layer 24 may comprise one or more selected from the group consisting of foamable or non-foamable thermoplastic polyurethanes, thermoplastic olefins, styrene block copolymers, thermoplastic vulcanizates, flexible polyolefins, fluoroelastomers, fluoropolymers, polyethylenes, Teflons, and blends thereof. In addition, peripheral layer 24 may be formed from thermoplastic olefinic elastomers such as petrothene TPOE, thermoplastic urethanes, thermoplastic polyesters, and other similar product formulas.

The particular composition employed for peripheral layer 24 is selected to withstand the compression forces imposed thereon by the jaws of the corking machine. However, many different polymers, as detailed above, are able to withstand these forces and, as a result, can be employed for peripheral layer 24.

In order to form synthetic bottle closure 20 with all of the desirable inherent physical and chemical properties detailed above, one compound that has been found to be most advantageous to employ for outer peripheral layer 24 is metallocene catalyst polyethylene. As detailed below, outer peripheral layer 24 may comprise 100% metallocene catalyst polyethylene or, if desired, the metallocene catalyst polyethylene may be intermixed with a polyethylene. In this regard, it has been found that outer peripheral layer 24 preferably comprises between about 25% and 100% by weight based upon the weight of the entire composition of one or more polyethylenes selected from the group consisting of medium density polyethylenes, medium low density polyethylenes, and low density polyethylenes.

A formulation which has been found to be highly effective in providing an outer peripheral layer 24 is metallocene catalyst polyethylene.

Another formulation which has been found to be highly effective in providing an outer peripheral layer 24 is a thermoplastic vulcanizate.

Another formulation which has been found to be highly effective in providing an outer peripheral layer 24 which meets all of the required physical and chemical attributes to attain a commercially viable synthetic bottle closure 20 is a polyether-type thermoplastic polyurethane and/or olefin block copolymer or blends thereof.

By employing this material and forming the material in peripheral, surrounding, bonded engagement with any desired foamed core member 22, a highly effective, multilayer synthetic closure is attained which is able to meet and exceed all requirements for a wine bottle closure.

In the preferred construction of this embodiment, the particular polyether-type thermoplastic polyurethane employed for forming outer peripheral layer 24 comprises Elastollan® LP9162, manufactured by BASF Corporation of Wyandotte, Mich. (US). As detailed below in the test data provided, this compound has been found to produce an outer layer in combination with core member 22 which provides all of the physical and chemical characteristics required for attaining a highly effective synthetic closure 20 for the wine industry.

In another preferred embodiment of the present invention, the outer peripheral layer comprises thermoplastic vulcanizates (TPV). Such thermoplastic vulcanizates are well known in the art and are commercially available, for example, under the tradename Santoprene® from ExxonMobil Chemical Company of Houston, Tex. (US), Sarlink® from DSM Thermoplastic Elastomers B.V., Geleen (NL) or OnFlex® from PolyOne Inc. of Avon Lake, Ohio (US).

In addition to employing the polyether-type thermoplastic polyurethane detailed above, another compound that has been found to be highly effective in providing all of the desirable attributes required for outer peripheral layer 24 is a blend of thermoplastic olefins and thermoplastic vulcanizates. In the preferred embodiment, the blend of thermoplastic olefins and thermoplastic vulcanizates comprises between about 100% and 90% by weight based upon the weight of the entire composition of the thermoplastic olefin and between about 100% and 90% by weight based upon the weight of the entire composition of the thermoplastic vulcanizate. As detailed below in the test data, the construction of synthetic closure 20 using an outer peripheral surface 24 formed from this blend provides a wine bottle closure which exceeds all requirements imposed thereon.

Another compound that has also been found to provide a highly effective outer peripheral layer 24 for synthetic closure 20 of the present invention comprises flexible polyolefins manufactured by Huntsman Corporation of Salt Lake City, Utah. These compounds are sold under the trademark REXflex FPO, and comprise homogeneous reactor-synthesized polymers, produced under proprietary technology which attains polymers having unique combinations of properties.

In a further alternate embodiment, a highly effective synthetic bottle closure 20 is attained by employing metallocene catalyst polyethylenes and/or olefin block copolymers, either independently or in combination with one selected from the group consisting of low density polyethylenes, medium density polyethylenes, and medium low density polyethylenes. In this embodiment, these materials are preferably employed for both core member 22 and peripheral layer 24.

Still further additional compounds which have been found to provide highly effective outer peripheral surfaces 24 for forming synthetic bottle closures 20, in accordance with the present invention, comprise teflon, fluoroelastomeric compounds and fluoropolymers. These compounds, whether employed individually or in combination with each other or with the other compounds detailed above have been found to be highly effective in producing an outer peripheral layer 24 which is capable of satisfying all of the inherent requirements for synthetic bottle closure 20.

Any of the compounds detailed herein for providing outer peripheral layer 24 can be employed using the extrusion processes detailed above to produce an outer layer which is securely and integrally bonded to core member 22, either as a foamed outer layer or a non-foamed outer layer. In addition, these compounds may also be employed using the molding processes detailed above to produce the desired synthetic bottle closure 20 of the present invention.

In addition, it has also been found that additives may be incorporated into outer peripheral layer 24 in order to further enhance the performance of the resulting synthetic bottle closure 20. As detailed above, these additional additives include slip resistant additives, lubricating agents, and sealing compounds.

It has also been discovered that further additional additives may be incorporated into either core member 22 and/or outer layer 24 of synthetic closure 20 in order to provide further enhancements and desirable performance characteristics. These additional additives incorporate antimicrobial agents, antibacterial compounds, and or oxygen scavenging materials. Suitable oxygen scavenging additives include, for example, sodium ascorbate, sodium sulfite, edetate dipotassium (dipotassium EDTA), hydroquinone, and similar substances are used to actively bind free oxygen. Oxygen scavenging additives are known in the art and are commercially available, for example, under the tradename Shelfplus O2® from Ciba AG at Basel (CH).

The antimicrobial and antibacterial additives can incorporated into the present invention to impart an additional degree of confidence that in the presence of a liquid the potential for microbial or bacterial growth is extremely remote. These additives have a long term time release ability and further increases the shelf life without further treatments by those involved with the bottling of wine. This technology has been shown to produce short as well as long term results (microbial and bacterial kills in as little as ten minutes with the long term effectiveness lasting for tens of years) which cannot be achieved with a natural product.

By employing any desired combination of these agents or additives, a further enhanced synthetic closure is realized which is capable of providing a product performance which has heretofore been incapable of being provided by either cork closures or conventional synthetic closures.

In order to attain the desired chemical and physical properties for the synthetic closure 20, core member 22 can comprise between about 0% and 75% by weight of metallocene catalyst polyethylene, and between about 25% and 100% by weight of one or more polyethylenes as detailed above. In forming peripheral layer 24 in secure, bonded interengagement therewith, it has been found that any of the formulations detailed above may be employed, with the selected formulations being affixed to core member 22 by co-extrusion or cross-head extrusion methods.

In order to demonstrate the efficacy of the present invention, samples of synthetic bottle closures 20, manufactured in accordance with the present invention and having a foamed core member and a solid peripheral layer were produced and tested. These sample products were produced on conventional co-extrusion equipment. Core member 22 was produced by employing low density polyethylene (LDPE) intermixed with varying concentrations of a fatty acid derivative additive using an inert gas as physical blowing agent. The fatty acid derivative employed was a 1:1 mixture of stearamide:palmitamide. The degree of foaming was adjusted so as to produce samples having a density of 240 kg/m$^3$ and 265 kg/m$^3$, respectively. In forming peripheral layer 24, a mixture of EPDM and PP and metallocene PE was employed. In the forming process, peripheral layer 24 was foamed in the extrusion equipment peripherally surrounding core member 22 and being intimately bonded thereto. The resulting products were cut in lengths suitable for forming bottle closure 20, followed by a chamfer being formed in edges 31 and 32. The resulting closures had a diameter of 22.5 mm and a length of 44 mm. The samples were then subjected to a Mocon test (OTR measurement system using 100% oxygen) in order to determine the oxygen transfer rate of the closure. The results of the OTR measurements are shown in the diagram depicted in FIG. 3. The results show that the use of fatty acid derivatives in accordance with the present invention significantly reduces the oxygen transfer rate (OTR) of synthetic closures as compared to closures not containing such additives. Furthermore, it was found that the additive did not have a negative impact on the operation of the extrusion machine and still allowed to properly control the performance characteristics such as extraction force, ovality control, diameter control and length control.

It will thus be seen that the objects set forth above, among those made apparent from the preceding description, are efficiently obtained and, since certain changes may be made in carrying out the above method without departing from the scope of this invention, it is intended that all matter contained in the above description or shown in the accompanying drawings shall be interpreted as illustrative and not in a limiting sense. Furthermore, it should be understood that the details of the invention described in the foregoing detailed description are not limited to the specific embodiments shown in the drawings but are rather meant to apply to the invention in general as outlined in the summary of the invention and in the claims.

It is also to be understood that the following claims are intended to cover all of the generic and specific features of the invention herein described, and all statements of the scope of the invention which, as a matter of language, might be said to fall there between.

Having described our invention, what we claim as new and desire to secure by Letters Patent is:

1. A synthetic closure for a product retaining container constructed for being inserted and securely retained in an interior surface of a portal forming neck of the container, wherein the closure comprises:

A. an elongated, cylindrically shaped core member comprising a cylindrical surface and terminating end surfaces, wherein the core member is formed from at least one foamed thermoplastic material comprising at least one fatty acid derivative, the at least one foamed thermoplastic material being selected from the group consisting of polyethylenes, metallocene catalyst polyethylenes, polybutanes, polyurethanes, silicones, vinyl-based resins, thermoplastic elastomers, polyesters, ethylenic acrylic copolymers, ethylene-vinyl-acetate copolymers, ethylene-methyl-acrylate copolymers, thermoplastic polyurethanes, thermoplastic olefins, thermoplastic vulcanizates, flexible polyolefins, fluorelastomers, fluoropolymers, polytetrafluoroethylenes, and blends thereof, ethylene-butyl-acrylate copolymers, ethylene-propylene-rubber, styrene butadiene rubber, styrene butadiene block copolymers, ethylene-ethyl-acrylic copolymers, ionomers, polypropylenes, and copolymers of polypropylene and copolymerizable ethylenically unsaturated comonomers, and mixtures thereof, wherein the at least one foamed thermoplastic material does not comprise a polybutylene; and B. at least one peripheral layer peripherally surrounding and intimately bonded to the cylindrical surface of the core member with the terminating end surfaces of the core member being devoid of the at least one peripheral layer;

wherein the synthetic closure is configured to completely seal a desired product in an interior volume of the container when the synthetic closure is inserted in the portal forming neck of the container;

wherein one of the terminating end surfaces of the core member is exposed to the interior volume of the container without contacting the interior surface of the portal forming neck of the container when the synthetic closure is inserted in the portal forming neck of the container;

wherein the closure has an oxygen transfer rate (OTR) in an axial direction as determined by Mocon measurement using 100% oxygen in a range of from about 0.0001 to about 0.1000 cc/day/closure; and wherein in order to impart OTR reducing effect to the closure, the at least one fatty acid derivative is present in a concentration of from about 0.01 to about 5 wt. %, based on a total weight of thermoplastic material, wherein the at least one fatty acid derivative reduces the oxygen transfer rate of the synthetic closure as compared to closures not comprising at least one fatty acid derivative.

2. The closure of claim 1, wherein the at least one fatty acid derivative is further defined as being selected from the group consisting of fatty acid esters and fatty acid amides.

3. The closure of claim 2, wherein the at least one fatty acid derivative is further defined as being a derivative of a saturated or unsaturated fatty acid having from about 12 to about 45 carbon atoms.

4. The closure of claim 3, wherein the at least one fatty acid derivative is further defined as being a derivative of a saturated or unsaturated fatty acid having from about 25 to 38 carbon atoms.

5. The closure of claim 2, wherein the fatty acid amides comprise at least one N-substituted fatty acid amide and/or at least one saturated fatty acid bis-amide or mixtures thereof.

6. The closure of claim 1, wherein the at least one fatty acid derivative is further defined as being selected from the group consisting of lauramide, palmitamide, arachidamide, behenamide, stearamide, 12-hydroxystearamide, oleamide, erucamide, recinoleamide, N-stearyl stearamide, N-behenyl behenamide, N-stearyl behenamide, N-behenyl stearamide, N-oleyl oleamide, N-oleyl stearamide, N-stearyl oleamide, N-stearyl erucamide, erucyl stearamide, erucyl erucamide, N-oleyl palmitamide, methylol stearamide, methylol behenamide, methylene bis-stearamide, ethylene bis-stearamide, ethylene bis-isostearamide, ethylene bis-hydroxystearamide, ethylene bis-behenamide, hexamethylene bis-stearamide, hexamethylene bis-behenamide, hexamethylene bis-hydroxystearamide, N,N'-distearyl adipamide, N,N'-distearyl sebacamide, ethylene bis-oleamide, hexamethylene bis-oleamide, N,N'-dioleyl adipamide, N,N'ethylenebis(stearamide), N,N' ethylenebis (palmitamide), glycerol mono stearate, and N,N'-dioleyl sebacamide.

7. The closure of claim 1, wherein the at least one fatty acid derivative is further defined as being selected from the group consisting of ethylenebis(stearamide) and ethylenebis (palmitamide) and mixtures thereof.

8. The closure of claim 1, wherein the at least one fatty acid derivative is further defined as being a mixture of ethylenebis(stearamide) and ethylenebis(palmitamide) in a ratio of between about 1:9 to about 9:1 by weight.

9. The closure of claim 1, wherein said closure has a substantially cylindrical shape comprising substantially flat terminating surfaces forming opposed ends of said closure.

10. The closure of claim 1 having an overall density from about 100 kg/m$^3$ to about 800 kg/m$^3$.

11. The closure of claim 10 having an overall density from about 200 kg/m$^3$ to about 500 kg/m$^3$.

12. The closure of claim 1, wherein said closure is wholly or partially foamed.

13. The closure of claim 12, wherein a cell size and/or cell distribution in foamed material of the closure are substantially uniform throughout an entire length and/or diameter of the foamed material.

14. The closure of claim 12, wherein foamed material of the closure comprises substantially closed cell foam.

15. The closure of claim 12, wherein foamed material of the closure has a cell size characterized by a range of between about 0.025 mm minimum and about 0.5 mm maximum.

16. The closure of claim 12, wherein foamed material of the closure has a cell size characterized by a range of between about 0.05 mm minimum to about 0.35 mm maximum.

17. The closure of claim 1, wherein said closure is further defined as having a silicone layer on at least a peripheral surface thereof.

18. The closure of claim 17, wherein said silicone layer is further defined as being formed by extrusion.

19. The closure of claim 1, wherein said core member comprises a density ranging between about 100 kg/m$^3$ to about 500 kg/m$^3$.

20. The closure of claim 1, wherein said core member comprises a density ranging between about 200 kg/m$^3$ to about 350 kg/m$^3$.

21. The closure of claim 1, wherein said core member is further defined as comprising closed cells having an average cell size ranging between about 0.02 millimeters to about 0.50 millimeters and/or a cell density ranging between about 8,000 cells/cm$^3$ to about 25,000,000 cells/cm$^3$.

22. The closure of claim 21, wherein said core member is further defined as comprising an average cell size ranging between about 0.05 mm and 0.1 mm and/or a cell density ranging between about 1,000,000 cells/cm$^3$ to about 8,000,000 cells/cm$^3$.

23. The closure of claim 1, wherein said at least one peripheral layer is further defined as comprising one selected from the group consisting of foamed plastics and nonfoamed plastics.

24. The closure of claim 1, wherein said at least one peripheral layer is further defined as comprising one or more compounds selected from the group consisting of foamable or non-foamable thermoplastic polyurethanes, thermoplastic olefins, thermoplastic vulcanizates, EPDM rubber, flexible polyolefins, fluoro-elastomers, fluoropolymers, polyethylenes, polytetrafluoroethylenes, olefin block copolymers, and blends thereof.

25. The closure of claim 1, wherein said at least one peripheral layer is further defined as comprising a thickness ranging between about 0.05 mm and about 5 mm.

26. The closure of claim 1, wherein said at least one peripheral layer is further defined as comprising a thickness ranging between about 0.1 mm and about 2 mm.

27. The closure of claim 1, wherein said at least one peripheral layer is further defined as comprising a tough, score-resistant and mar-resistant surface and/or a density ranging between about 300 kg/m$^3$ and 1,500 kg/m$^3$.

28. The closure of claim 1, wherein said at least one peripheral layer is further defined as comprising a density between about 750 kg/m$^3$ and about 1100 kg/m$^3$.

29. The closure of claim 1, wherein said closure is further defined as being formed by extrusion and/or injection molding.

30. The closure of claim 1, wherein at least one of said core member and said at least one peripheral layer are further defined as being formed by extrusion.

31. The closure of claim 30, wherein said core member is further defined as being pre-formed by extrusion separately from the at least one peripheral layer, and said at least one peripheral layer is subsequently formed in extrusion equipment peripherally surrounding and enveloping the pre-formed core member.

32. The closure of claim 1, wherein said core member and said at least one peripheral layer are further defined as being extruded simultaneously.

33. The closure of claim 1, comprising from about 0.1 to about 5 wt. % of said at least one fatty acid derivative, based on the total weight of thermoplastic material.

34. The closure of claim 33, comprising from about 1 to about 3 wt. % of said at least one fatty acid derivative, based on the total weight of thermoplastic material.

35. The closure of claim 1 having an oxygen transfer rate (OTR) in an axial direction as determined by Mocon measurement using 100% oxygen from about 0.0005 to about 0.050 cc/day/closure.

36. A synthetic closure for a product retaining container constructed for being inserted and securely retained in an interior surface of a portal forming neck of the container, the closure comprising:

A. an elongated, cylindrically shaped core member comprising a cylindrical surface and terminating end surfaces, wherein the core member is formed from at least one foamed thermoplastic material comprising at least one fatty acid derivative; and B. at least one peripheral layer peripherally surrounding and intimately bonded to the cylindrical surface of the core member with the terminating end surfaces of the core member being devoid of the at least one peripheral layer;

wherein the synthetic closure is configured to completely seal a desired product in an interior volume of the container when the synthetic closure is inserted in the portal forming neck of the container;

wherein one of the terminating end surfaces of the core member is exposed to the interior volume of the container without contacting the interior surface of the portal forming neck of the container when the synthetic closure is inserted in the portal forming neck of the container;

wherein the closure has a density of from about 100 kg/m$^3$ to about 800 kg/m$^3$ and an oxygen transfer rate (OTR) as determined by Mocon measurement using 100% oxygen of from about 0.0001 to about 0.1000 cc/day/closure;

wherein the at least one foamed thermoplastic material of the core member is selected from the group consisting of polyethylenes, metallocene catalyst polyethylenes, polybutanes, polyurethanes, silicones, vinyl-based resins, thermoplastic elastomers, polyesters, ethylenic acrylic copolymers, ethylene-vinyl-acetate copolymers, ethylene-methyl-acrylate copolymers, ethylene-butyl-acrylate copolymers, ethylene-propylene rubber, styrene butadiene rubber, styrene butadiene block copolymers, ethylene-ethyl-acrylic copolymers, ionomers, polypropylenes and copolymers of polypropylene, copolymerisable ethylenically unsaturated comonomers and/or mixtures thereof, wherein the at least one foamed thermoplastic material of the core member does not comprise a polybutylene; and wherein in order to impart OTR reducing effect to the closure, the at least one fatty acid derivative is present in a concentration of from about 0.01 to about 5 wt. %, based on a total weight of thermoplastic material, wherein the at least one fatty acid derivative reduces the oxygen transfer rate of the synthetic closure as compared to closures not comprising at least one fatty acid derivative.

37. The closure of claim 36, wherein said closure comprises at least one of the following features (i) to (vii):

(i) the at least one fatty acid derivative is selected from the group consisting of fatty acid esters and fatty acid amides;

(ii) the at least one fatty acid derivative comprises a derivative of a saturated or unsaturated fatty acid having from about 12 to about 45 carbon atoms;

(iii) the at least one fatty acid derivative comprises at least one N-substituted fatty acid amide and/or at least one saturated fatty acid bis-amide or mixtures thereof;

(iv) the at least one fatty acid derivative is selected from the group consisting of lauramide, palmitamide, arachidamide, behenamide, stearamide, 12-hydroxystearamide, oleamide, erucamide, recinoleamide, N-stearyl stearamide, N-behenyl behenamide, N-stearyl behenamide, N-behenyl stearamide, N-oleyl oleamide, N-oleyl stearamide, N-stearyl oleamide, N-stearyl erucamide, erucyl stearamide, erucyl erucamide, N-oleyl palmitamide, methylol stearamide, methylol behenamide, methylene bis-stearamide, ethylene bis-stearamide, ethylene bis-isostearamide, ethylene bis-hydroxystearamide, ethylene bis-behenamide, hexamethylene bis-stearamide, hexamethylene bis-behenamide, hexamethylene bis-hydroxystearamide, N,N'-distearyl adipamide, N,N'-distearyl sebacamide, ethylene bis-oleamide, hexamethylene bis-oleamide, N,N'-dioleyl adipamide, N,N'ethylenebis(stearamide), N,N' ethylenebis(palmitamide), glycerol mono stearate, and N,N'-dioleyl sebacamide;

(v) the at least one fatty acid derivative is selected from the group consisting of ethylenebis(stearamide) and ethylenebis(palmitamide) and mixtures thereof;

(vi) the at least one fatty acid derivative comprises a mixture of ethylenebis(stearamide) and ethylenebis (palmitamide) in a ratio of between about 1:9 to about 9:1 by weight; or (vii) the closure comprises from about 0.01 to about 5 wt. % of said at least one fatty acid derivative, based on a total weight of thermoplastic material.

38. The closure of claim 36 having a density from about 200 kg/m$^3$ to about 500 kg/m$^3$.

39. The closure of claim 36 having an oxygen transfer rate (OTR) as determined by Mocon measurement using 100% oxygen from 0.0005 to 0.050 cc/day/closure.

40. A synthetic closure for a product retaining container constructed for being inserted and securely retained in an interior surface of a portal forming neck of the container, the closure comprising:

A. an elongated, cylindrically shaped core member comprising a cylindrical surface and terminating end surfaces, wherein the core member is formed from at least one foamed thermoplastic material comprising at least one fatty acid derivative; and B. at least one peripheral layer peripherally surrounding and intimately bonded to the cylindrical surface of the core member with the terminating end surfaces of the core member being devoid of the at least one peripheral layer;

wherein the synthetic closure is configured to completely seal a desired product in an interior volume of the container when the synthetic closure is inserted in the portal forming neck of the container;

wherein one of the terminating end surfaces of the core member is exposed to the interior volume of the container without contacting the interior surface of the portal forming neck of the container when the synthetic closure is inserted in the portal forming neck of the container;

wherein the closure has a density of less than about 350 $kg/m^3$, and an oxygen transfer rate (OTR) as determined by Mocon measurement using 100% oxygen of less than about 0.025 cc/day/closure;

wherein the at least one foamed thermoplastic material of the core member is selected from the group consisting of polyethylenes, metallocene catalyst polyethylenes, polybutanes, polyurethanes, silicones, vinyl-based resins, thermoplastic elastomers, polyesters, ethylenic acrylic copolymers, ethylene-vinyl-acetate copolymers, ethylene-methyl-acrylate copolymers, ethylene-butyl-acrylate copolymers, ethylene-propylene rubber, styrene butadiene rubber, styrene butadiene block copolymers, ethylene-ethyl-acrylic copolymers, ionomers, polypropylenes and copolymers of polypropylene, copolymerisable ethylenically unsaturated comonomers and/or mixtures thereof, wherein the at least one foamed thermoplastic material of the core member does not comprise a polybutylene; and wherein in order to impart OTR reducing effect to the closure, the at least one fatty acid derivative is present in a concentration of from about 0.01 to about 5 wt. %, based on a total weight of thermoplastic material, wherein the at least one fatty acid derivative reduces the oxygen transfer rate of the synthetic closure as compared to closures not comprising at least one fatty acid derivative.

41. The closure of claim 40 having a density of less than about 300 $kg/m^3$.

42. The closure of claim 40 having an oxygen transfer rate (OTR) as determined by Mocon measurement using 100% oxygen of less than about 0.015 cc/day/closure.

43. A synthetic closure for a product retaining container constructed for being inserted and securely retained in a portal forming neck of said container, said closure comprising a foamed core member and a peripheral layer cylindrically enveloping the foamed core member, the peripheral layer having a density of from 300 to 1500 $kg/m^3$ and being devoid of any fatty acid derivative, wherein the foamed core member comprises at least one thermoplastic polymer and at least one fatty acid derivative, wherein the at least one thermoplastic polymer is selected from the group consisting of polyethylenes, metallocene catalyst polyethylenes, polybutanes, polyurethanes, silicones, vinyl-based resins, thermoplastic elastomers, polyesters, ethylenic acrylic copolymers, ethylene-vinyl-acetate copolymers, ethylene-methyl-acrylate copolymers, ethylene-butyl-acrylate copolymers, ethylene-propylene rubber, styrene butadiene rubber, styrene butadiene block copolymers, ethylene-ethyl-acrylic copolymers, ionomers, polypropylenes and copolymers of polypropylene, copolymerisable ethylenically unsaturated comonomers and/or mixtures thereof wherein the at least one thermoplastic polymer of the foamed core member does not comprise a polybutylene; and wherein in order to impart oxygen transfer rate (OTR) reducing effect to the closure, the at least one fatty acid derivative is present in a concentration of from about 0.01 to about 5 wt. %, based on a total weight of thermoplastic polymer, wherein the at least one fatty acid derivative reduces the oxygen transfer rate of the synthetic closure as compared to closures not comprising at least one fatty acid derivative.

* * * * *